United States Patent [19]

Ryer, II

[11] 4,216,631

[45] Aug. 12, 1980

[54] PAPER CLAMPING DEVICE FOR SANDING MACHINE

[75] Inventor: Richard N. Ryer, II, Cleveland, S.C.

[73] Assignee: The Singer Company, Stamford, Conn.

[21] Appl. No.: 6,395

[22] Filed: Jan. 25, 1979

[51] Int. Cl.[2] ..... B24D 17/00

[52] U.S. Cl. ..... 51/170 MT; 51/392

[58] Field of Search ... 51/170 MT, 170 TL, 382–386, 51/391–393

[56] References Cited

U.S. PATENT DOCUMENTS

| | | | |
|---|---|---|---|
| 1,320,299 | 10/1919 | Wilson | 51/392 |
| 1,522,459 | 1/1925 | Jackowitz | 51/382 |
| 2,334,173 | 11/1943 | Champayne | 51/384 |
| 2,475,476 | 7/1949 | Champayne | 51/384 |
| 2,683,337 | 7/1954 | Scace | 51/384 |
| 2,893,174 | 7/1959 | Jepson | 51/170 MT |
| 3,014,316 | 12/1961 | Barnhart | 51/391 |
| 3,136,099 | 6/1964 | Tully et al. | 51/170 MT |
| 3,540,161 | 11/1970 | Anton et al. | 51/382 |
| 3,822,518 | 7/1974 | Sjostrand | 51/386 |
| 3,848,850 | 11/1974 | Metoff | 51/170 MT |
| 3,973,362 | 8/1976 | Groshans | 51/386 |
| 4,030,254 | 6/1977 | Marcantonio | 51/386 |
| 4,077,165 | 3/1978 | Hutchins | 51/386 |

*Primary Examiner*—Nicholas P. Godici

*Assistant Examiner*—Roscoe V. Parker

*Attorney, Agent, or Firm*—Elliot A. Lackenbach; Robert E. Smith; Edward L. Bell

[57] ABSTRACT

In a power driven, portable surface treating machine, a mechanism is provided for clamping a surface treating material to the back plate of the surface treating machine. The clamping mechanism comprises a back plate having a clamp seat at one end thereof extending horizontally across substantially the entire length of said one end of said back plate, and a device for clamping one end of the surface treating material. The clamping device includes a manipulative over-center camming lever pivotably supported on the back plate, the lever having a power arm section which has a finger grip at its rear and a camming arm section offset laterally from the forward end of the power arm section. The clamping device also includes a reciprocably shiftable, resilient wire clamping member having a connecting section substantially perpendicular to and pivotably mounted on the camming arm section of the lever and a clamping section fixedly secured to the connecting section and extending substantially parallel to the clamp seat in the back plate, whereby when the camming lever is moved to its over-center position the clamping section of the resilient wire clamping member aligns itself within the clamp seat to thereby clamp the end of the surface treating material.

7 Claims, 7 Drawing Figures

PAPER CLAMPING DEVICE FOR SANDING MACHINE

DESCRIPTION

BACKGROUND OF THE INVENTION

The instant invention relates to surface treating machines, and more particularly to clamps for power driven devices or tools adapted to be manipulated over a surface to be treated for sanding, grinding, polishing, or buffing.

Since the most common use of such surface treating devices is with respect to sanding such surface to be treated, it is usual to refer to such devices as power sanders, although obviously they can be used for other than sanding operations. In the ensuing description and claims, when reference is made to a power sander, it is intended to connote broadly surface treating devices.

In surface treating machines, of which perhaps the most important is a sanding machine, the portable electric sander has become very popular in recent years. There is hardly an adult person today who has not had occasion to use a sander in some form or other for treating a surface, whether it be the surface of a piece of furniture or some other project. As a result of the "do-it-yourself" trend, there has been a tremendous increase in the demand for portable electric sanders, and there have been extensively sold on the market several types of these sanders, among which are the purely vibratory sander, the rotary disk type sander, the belt type sander, the orbital sander, dual motion (orbital and vibratory) sanders, and others. Of the several types of sanders, the orbital, the vibratory and the dual motion sanders offer the greatest utility for all-around work, and the present invention is particularly concerned with these sanders.

A surface treating machine such as an electric sander requires simple and readily actuatable means for releasing and securing the sandpaper to the machine. In any particular sanding operation, it may be desirable to start the surface treating machine with a coarse sandpaper, followed by a medium and then a fine paper, and this action may be followed by a waxing or polishing operation using the same surface treating machine. Obviously, this requires a mechanism for quickly and easily attaching and releasing sandpaper or other surface treating material, and it would be desirable to provide a locking device which easily clamps any form of abrasive such as sandpaper tightly thereto regardless of the thickness of the abrasive paper and without the requirement of any tools.

The prior art abounds with clamping devices for vibratory and orbital sanders, including several over-center locking devices. However, most of the overcenter clamping devices include spring members, thereby complicating assembly of the sander and requiring considerable effort to lock and release the sandpaper. The instant invention overcomes the problems associated with prior art over-center clamping devices by providing an over-center clamping device which can be easily assembled without any spring tension and which is easily moved into a locking position to clamp the sandpaper tightly.

SUMMARY OF THE INVENTION

In a power driven, portable surface treating machine, a mechanism is provided for clamping a surface treating material to the back plate of the surface treating machine. The clamping mechanism comprises a back plate having a clamp seat at one end thereof extending horizontally across substantially the entire length of said one end of said back plate, and a device for clamping one end of the surface treating material. The clamping device includes a manipulative over-center toggle lever pivotably supported on the back plate, the lever having a power arm section which has a finger grip at its rear and a toggle arm section offset laterally from the forward end of the power arm section. The clamping device also includes a reciprocably shiftable, resilient wire clamping member having a connecting section substantially perpendicular to and pivotably mounted on the toggle arm section of the lever and a clamping section fixedly secured to the connecting section and extending substantially parallel to the clamp seat in the back plate, whereby when the toggle lever is moved to its over-center position the clamping section of the resilient wire clamping member aligns itself within the clamp seat to thereby clamp the end of the surface treating material.

DETAILED DESCRIPTION

Figure 1:
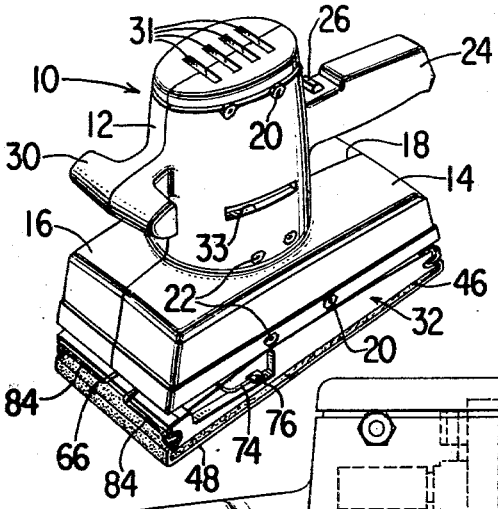
FIG. 1 is a perspective view of an orbital sander embodying a clamping mechanism according to the instant invention.
Figure 2:
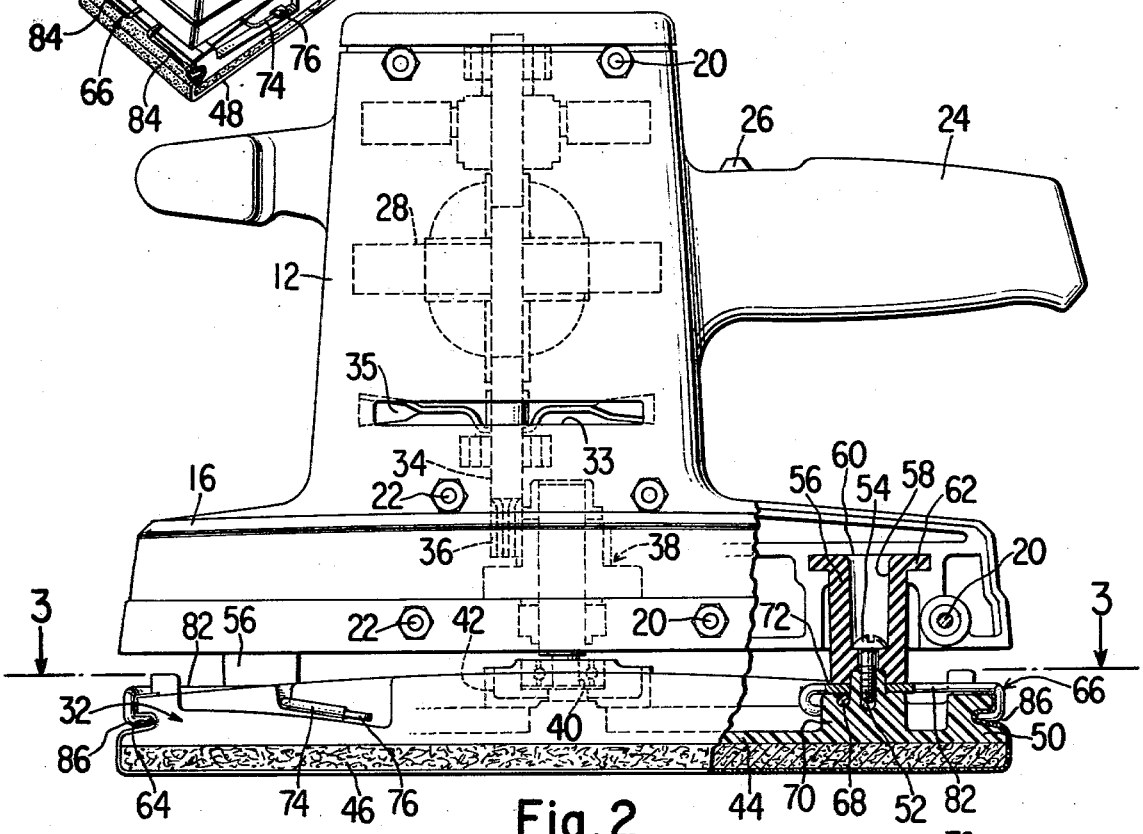
FIG. 2 is an enlarged, side elevational view of the sander shown in FIG. 1 with the rear end of the sander broken away.

In describing the preferred embodiment of the instant invention, reference is made to the drawings, wherein there is seen in FIG. 1 an electrically driven, portable, orbital sander 10 having a clam shell housing 12 comprising a pair of complementary halves 14 and 16, which are detachably connected along a longitudinal split 18 by machine screws 20 and nuts 22 (see FIG. 2). A main handle 24 formed integral with the housing 12 is provided with an operator-controlled electric on-off switch 26 between a motor 28 and a suitable source of electric power. A forwardly positioned auxiliary handle 30 is also provided so that the sander 10 can be grasped and controlled by the operator. The housing 12 is provided with slots 31 for the entry of cooling air for the motor 28 and with at least one slot 33 for the exit of the air from the sander 10.

The motor 28 drives a platen assembly 32 connected to the housing 12 at the bottom thereof. An armature shaft 34 of the motor 28 has a pinion 36 formed on its lower end which, through a gear reduction mechanism 38 having an eccentric crank 40 at its lower end connects to and eccentrically drives a bearing bracket 42 mounted on the rectangular rigid back plate 44 of the platen assembly 32. The bearing bracket 42 thereby imparts orbital motion to the rectangular, rigid back plate 44. The armature shaft 34 is also furnished with a fan 35 to induce cooling air through the slots 31.

A resilient pad 46 is bonded to the back plate 44 on which is typically mounted suitable sandpaper 48. Both the pad 46 and back plate 44 are essentially planar except for the terminal, longitudinally extending edges 50 at the ends of the back plate 44 which are turned up along their lengths to thereby enable the edges 50 to function as clamp seats, as described in greater detail hereinafter.

Figure 3:
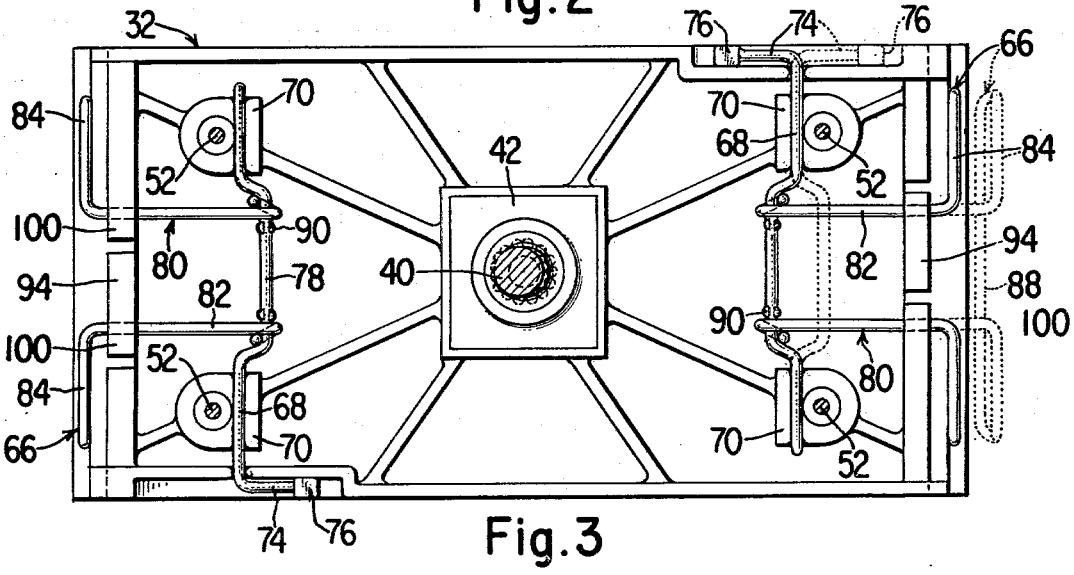
FIG. 3 is an enlarged, sectional view taken on the horizontal plane indicated by the line 3—3 of FIG. 2.
Figure 4:
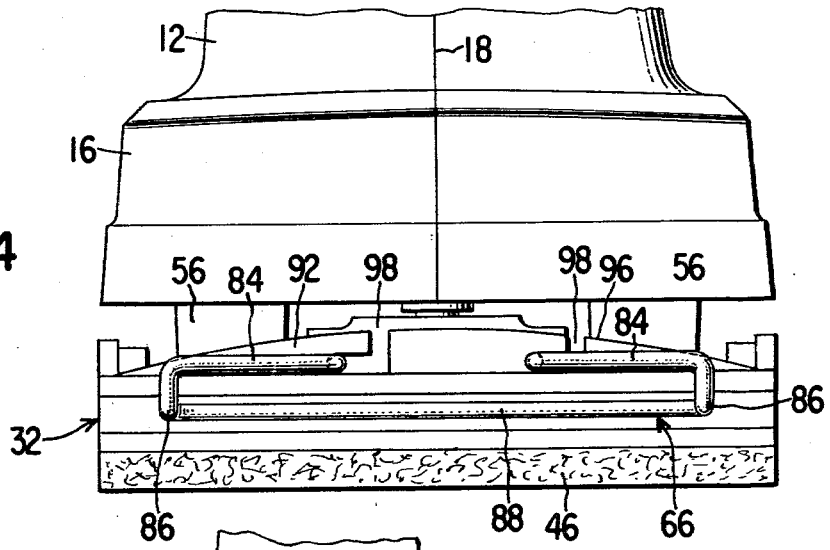
FIG. 4 is an enlarged, fragmentary, front elevational view of the sander shown in FIG. 1.
Figure 5:
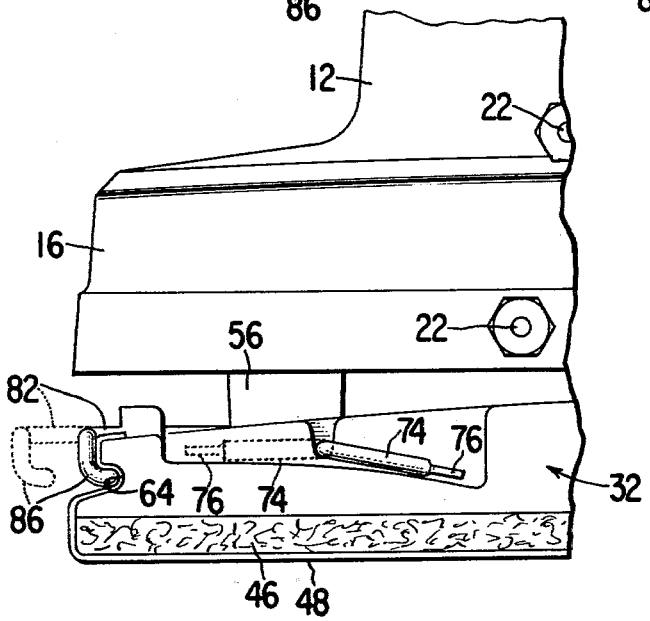
FIG. 5 is an enlarged, fragmentary, side elevational view of the sander shown in FIG. 1.
Figure 6:
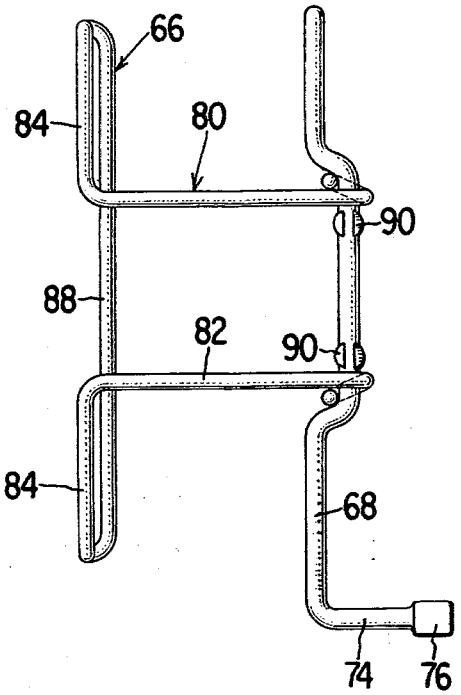
FIG. 6 is an enlarged, top plan view of the clamping mechanism shown in FIG. 1.
Figure 7:
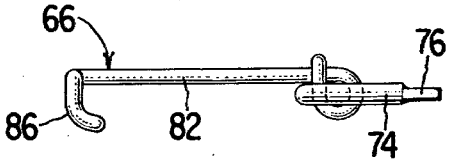
FIG. 7 is an enlarged, side elevational view of the clamping mechanism shown in FIG. 6.

The platen assembly 32, in its preferred form, is rectangular in plan view as can be seen most clearly in FIGS. 1 and 3. The back plate 44 is provided, adjacent each of its four corners, with apertures 52 which receive a self-tapping metal screw 54. Four resilient posts 56, preferably formed from a hard rubber, are provided with through apertures 58 through which screws 54 pass, thereby fastening the four posts 56 to the back plate 44.

The housing 12 is provided at each end with a transversely extending, generally U-shaped recess 60 dimensioned to receive the top flange 62 which is formed on each of the resilient posts 56. The thickness of the flange 62, which is generally rectangular in configuration, in such that upon assembly with the housing 12 the flange 62 will be accepted within the recess 60. Preferably a sliding fit between the flange 62 and internal walls of the recess 60 is provided, although the height of the recess 60 may be tapered slightly from the opening at the longitudinal split 18 in the housing 12 to the outer sidewall of the housing 12 to enhance retention of the flange 62 within the recess 60. It will also be appreciated that by forming the recess 60 with a tapered height the insertion of the flange 62 into the recess 60 during assembly will be facilitated, thereby aiding assembly in the mass production of the sander 10.

Each of the longitudinally extending edges 50 of the back plate 44 includes a groove 64 extending horizontally through the entire length of the edge 50. The groove 50 functions as a seat for a clamping device 66 which clamps the ends of the sandpaper 48 to the resilient pad 46. The clamping device 66 includes a manipulative, over-center toggle lever 68 pivotably supported in a rigid post 70 formed integral with the back plate 44. The lever 68 is held in position, as best seen in FIG. 2, by a washer 72 situated under the resilient post 56. The lever 68 includes a power arm section 74 having a finger grip 76 at its rear and a toggle arm section 78 offset laterally from the forward end of the power arm section 74.

The clamping device 66 also includes a reciprocably shiftable, resilient wire clamping member 80 having two connecting sections 82 perpendicular to and pivotably mounted on the toggle arm section 78, and a pair of transverse members 84 each extending laterally from one of the connecting sections 82. A pair of angular legs 86 extend downwardly and inwardly toward the lever 68, and extending between the legs 86 parallel to the groove 50 is a clamping section or bight 88.

Protuberances 90 are formed on the toggle arm section 78 just inside the connecting sections 82 to center the connecting section 82 on the toggle arm section 78. Extending upwardly from each of the longitudinally extending edges 50 are three arced projections 92, 94 and 96 respectively, with spaces therebetween to define a pair of gaps 98. The projections 92 and 94 include therein recesses 100 adjacent the gaps 98. The connecting sections 82, as further explained below, reciprocate horizontally in and are guided by the recesses 100.

In using the clamping device 66, the operator takes one end of the sandpaper 48 and lays it over the groove 64, with the appropriate clamping device 66 in the release position, as seen by the dotted lines of FIG. 3. The toggle lever 68 is then grasped by a finger at the finger grip 76 and merely rotated to the over-center position shown by the solid lines in FIG. 3, thereby causing the wire clamping member 80 to move inwardly toward the groove 64 and grip the end of the sandpaper 48 with the clamping bight 80. The sandpaper 48 is then laid across the resilient pad 46 and around the other groove 64, and the same operation with the other clamping device 66 is repeated.

It can be seen that the toggle lever 68 actuates the clamping member 80 to move in a horizontal plane without the use of any spring members. The clamping device 66 effectively locks the sandpaper 48 against possible release by vibratory forces developed during operation of the sander 10 by its being moved to the over-center position without the need for any locking tabs or projections. Clearly then, the clamping device 66 is one which is easily moved by the operator.

It will be understood that various changes in the details, materials, arrangements of parts and operating conditions which have been herein described and illustrated in order to explain the nature of the invention may be made by those skilled in the art within the principles and scope of the invention.

I claim:

1. In a power driven, portable surface treating machine, a mechanism for clamping a surface treating material to the back plate of the surface treating machine, comprising:

a back plate having a clamp seat at one end thereof extending horizontally across substantially the entire length of said one end of said back plate; and a device for clamping one end of the surface treating material, said clamping device having a manipulative over-center toggle lever pivotably supported on said back plate, said lever having a power arm section having a finger grip at its rear and a toggle arm section offset laterally from the forward end of the power arm section, and a reciprocably shiftable, resilient wire clamping member having a connecting section substantially perpendicular to and pivotably mounted on the toggle arm section of the lever and a clamping section fixedly secured to the connecting section and extending substantially parallel to the clamp seat in the back plate, whereby when the lever is moved to its over-center position the connecting section moves horizontally and the clamping section of the resilient wire clamping member aligns itself within the clamp seat to thereby clamp the end of the surface treating material.

2. The mechanism of claim 1, wherein the back plate includes longitudinally extending edges at its ends, each of said edges being turned up along its length and having a groove therein extending horizontally through the length of the edge.

3. The mechanism of claim 2, wherein the resilient wire clamping member includes two connecting sections spaced from each other.

4. The mechanism of claim 3, further comprising a pair of transverse members each perpendicular to and extending laterally from each of the connecting sections, and a pair of angular legs each extending downwardly and inwardly from its respective transverse member to the clamping section.

5. The mechanism of claim 4, wherein the toggle arm section includes protuberances inside the connecting sections to center the connecting sections on the camming arm section.

6. The mechanism of claim 5, additionally comprising at least two spaced projections extending upwardly from each of the longitudinally extending edges, each of the two projections having a recess therein to receive the horizontally movable connecting sections of the resilient wire clamping member.

7. The mechanism of claim 6, wherein the surface treating machine is an orbital sander.

* * * * *